US011220732B2

(12) United States Patent
Kawabe et al.

(10) Patent No.: US 11,220,732 B2
(45) Date of Patent: Jan. 11, 2022

(54) FERRITIC STAINLESS STEEL SHEET

(71) Applicant: JFE Steel Corporation, Tokyo (JP)

(72) Inventors: Hidetaka Kawabe, Tokyo (JP); Shuji Nishida, Tokyo (JP); Mitsuyuki Fujisawa, Tokyo (JP); Chikara Kami, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 366 days.

(21) Appl. No.: 16/310,956

(22) PCT Filed: Jun. 15, 2017

(86) PCT No.: PCT/JP2017/022134

§ 371 (c)(1),
(2) Date: Dec. 18, 2018

(87) PCT Pub. No.: WO2018/003521

PCT Pub. Date: Jan. 4, 2018

(65) Prior Publication Data

US 2020/0308677 A1 Oct. 1, 2020

(30) Foreign Application Priority Data

Jun. 27, 2016 (JP) ..... JP2016-126353
Jun. 27, 2016 (JP) ..... JP2016-126354

(51) Int. Cl.
*C22C 38/42* (2006.01)
*C21D 9/46* (2006.01)
(Continued)

(52) U.S. Cl.
CPC ..... *C22C 38/42* (2013.01); *C21D 9/46* (2013.01); *C22C 38/001* (2013.01);
(Continued)

(58) Field of Classification Search
None
See application file for complete search history.

(56) References Cited

U.S. PATENT DOCUMENTS 8,894,924 B2 11/2014 Matsuhashi et al.
2013/0129560 A1 5/2013 Matsuhashi et al.
(Continued)

FOREIGN PATENT DOCUMENTS

CN 101680066 A 3/2010
CN 101573466 A 6/2012
(Continued)

OTHER PUBLICATIONS

International Search Report and Written Opinion for International Application No. PCT/JP2017/022134, dated Sep. 5, 2017—4 pages.
(Continued)

*Primary Examiner* — Nicholas A Wang
(74) *Attorney, Agent, or Firm* — RatnerPrestia

(57) ABSTRACT

Provided is a ferritic stainless steel sheet excellent in shape of weld zone and corrosion resistance of a weld zone with a material of a different kind formed by performing welding with austenitic stainless steel.

A ferritic stainless steel sheet having a chemical composition containing, by mass %, C: 0.003% to 0.020%, Si: 0.01% to 1.00%, Mn: 0.01% to 0.50%, P: 0.040% or less, S: 0.010% or less, Cr: 20.0% to 24.0%, Cu: 0.20% to 0.80%, Ni: 0.01% to 0.60%, Al: 0.01% to 0.08%, N: 0.003% to 0.020%, Nb: 0.40% to 0.80%, Ti: 0.01% to 0.10%, Zr: 0.01% to 0.10%, and the balance being Fe and inevitable impurities, in which relational expression (1) below is satisfied:

$$3.0 \geq Nb/(2Ti+Zr+0.5Si+5Al) \geq 1.5 \quad (1),$$

here, in relational expression (1), each of the atomic symbols denotes the content (mass %) of the corresponding chemical element.

16 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/60*** | (2006.01) |

(52) U.S. Cl.

CPC ..... *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/60* (2013.01); *C21D 2211/005* (2013.01)

(56) References Cited

U.S. PATENT DOCUMENTS

| | | | | |
|---|---|---|---|---|
| 2014/0023432 | A1* | 1/2014 | Matsuhashi ..... | B23K 9/025 403/272 |
| 2015/0292068 | A1* | 10/2015 | Teraoka ..... | C21D 1/26 148/605 |

FOREIGN PATENT DOCUMENTS

| | | | |
|---|---|---|---|
| CN | 103510013 | A | 1/2014 |
| EP | 2163658 | A1 | 3/2010 |
| EP | 2975151 | A1 | 1/2016 |
| EP | 3153599 | A1 | 4/2017 |
| JP | 08170154 | A | 7/1996 |
| JP | 2011246814 | A | 12/2011 |
| JP | 2012036444 | A | 2/2012 |
| JP | 5205951 | B2 | 6/2013 |
| JP | 5489759 | B2 | 5/2014 |
| TW | 201441385 | A | 11/2014 |
| TW | 201615546 | A | 5/2016 |
| WO | 2008082096 | A1 | 7/2008 |
| WO | 2016035241 | A1 | 3/2016 |

OTHER PUBLICATIONS

Taiwan Office Action for Taiwan Application No. 106121081, dated Jan. 16, 2018, with Concise Statement of Relevance of Office Action, 5 pages.

Extended European Search Report for European Application No. 17 819 881.8, dated Mar. 18, 2019, 8 pages.

Korean Office Action for Korean Application No. 10-2018-7036383 dated Feb. 14, 2020, with Concise Statement of Relevance of Office Action, 5 pages.

Chinese Office Action with Search Report for Chinese Application No. 201780039942.2, dated Apr. 9, 2020, 8 pages.

* cited by examiner

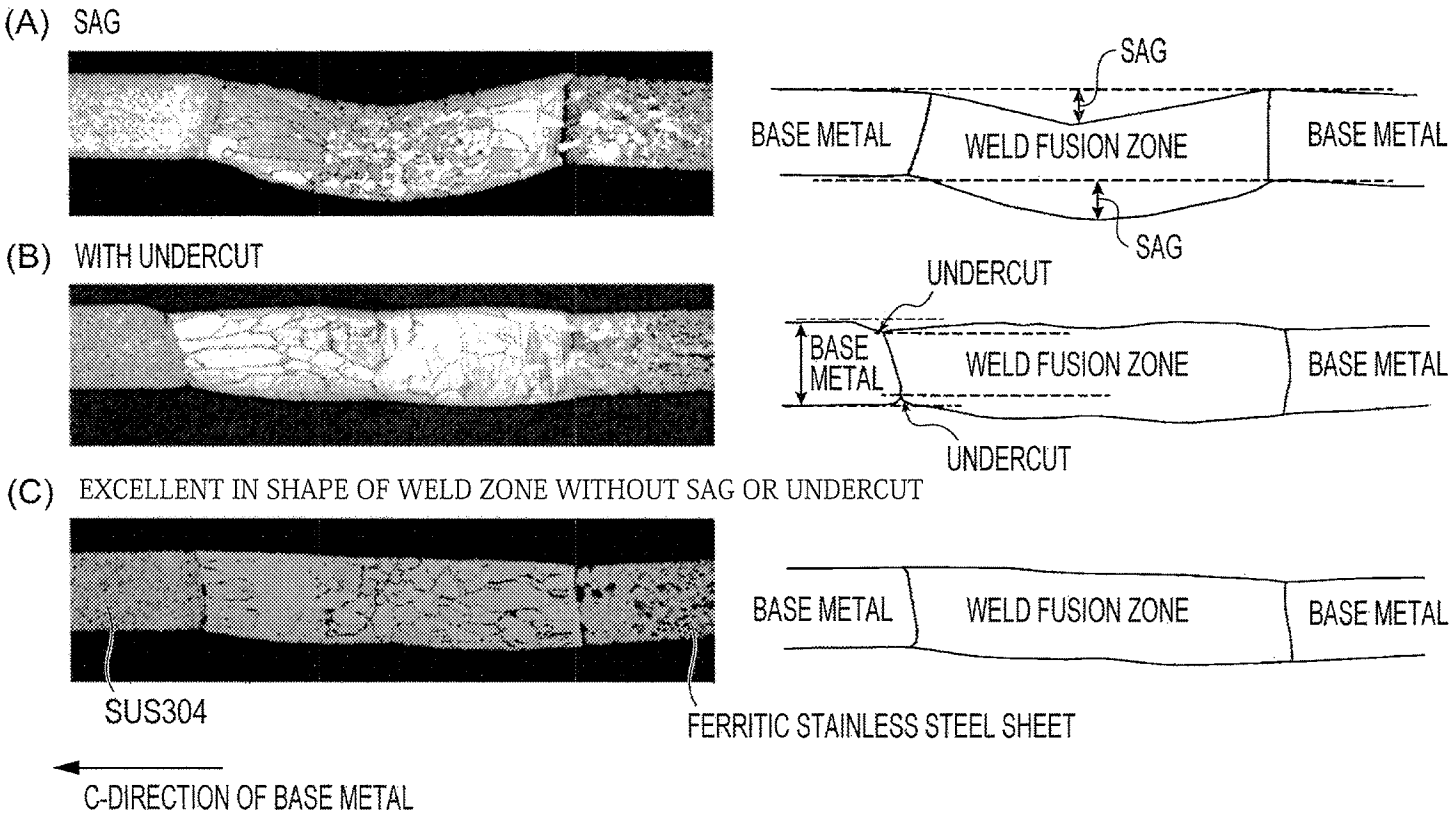
(A) SAG
SAG
BASE METAL
WELD FUSION ZONE
SAG
BASE METAL
(B) WITH UNDERCUT
UNDERCUT
BASE METAL
WELD FUSION ZONE
UNDERCUT
BASE METAL
(C) EXCELLENT IN SHAPE OF WELD ZONE WITHOUT SAG OR UNDERCUT
BASE METAL
WELD FUSION ZONE
BASE METAL
FERRITIC STAINLESS STEEL SHEET
SUS304
C-DIRECTION OF BASE METAL

FERRITIC STAINLESS STEEL SHEET

CROSS REFERENCE TO RELATED APPLICATIONS

This is the U.S. National Phase application of PCT/JP2017/022134, filed Jun. 15, 2017, which claims priority to Japanese Patent Application No. 2016-126353, filed Jun. 27, 2016 and Japanese Patent Application No. 2016-126354, filed Jun. 27, 2016, the disclosures of each of these applications being incorporated herein by reference in their entireties for all purposes.

FIELD OF THE INVENTION

The present invention relates to a ferritic stainless steel sheet. In particular, the present invention relates to a ferritic stainless steel sheet excellent in shape of weld zone. In addition, in the preferable embodiments of the present invention, the present invention also relates to a ferritic stainless steel sheet excellent in the surface quality of a weld zone after working.

BACKGROUND OF THE INVENTION

Since a ferritic stainless steel sheet is less expensive than an austenitic stainless steel sheet, which contains a large amount of expensive Ni, ferritic stainless steel sheets are used in many applications. For example, a ferritic stainless steel sheet is used in a wide range of various applications, such as home electrical appliances, kitchen appliances, architectural members, architectural hardware, and structural members.

There may be a case where a stainless steel sheet is used in such a manner that the steel sheet is formed into members having predetermined shapes by performing press forming and then the several members are assembled by performing welding. Welding is important for obtaining sound products, and in particular, shape of weld zone is very important. For example, in the case where a weld zone has a shape defect such as an undercut, since there is a decrease in the strength of a welded joint or there may be a case where a crack or fatigue fracturing starts at the weld zone due to stress concentration, it is necessary to take an appropriate treatment. In addition, shape of weld zone is also important in the case of members which are used in such a manner that the members are polished after welding. For example, in the case where there is a sag such that a weld metal is lower than the level of the butted portion of base metals, since burning removal polishing (the removal of temper color through polishing) is not sufficiently performed, there may be a case where it is difficult to achieve sufficient corrosion resistance of the weld zone.

Moreover, since stainless steel sheets are used in applications in which sufficient corrosion resistance is required, the weld zone of a steel sheet is also required to have sufficient corrosion resistance. Since welding is performed not only between materials of the same kind but also between materials of different kinds, for example, with an austenitic stainless steel sheet, it is necessary to achieve sufficient corrosion resistance of a weld zone not only of materials of the same kind but also of materials of different kinds.

Therefore, various investigations have been conducted to achieve sufficient weldability and sufficient corrosion resistance of a weld zone of materials of different kinds.

As an example of a technique regarding weldability, Patent Literature 1 discloses a method in which sufficient ductility of a weld zone is achieved by controlling the contents of O, Al, Si, and Mn of low-Cr steel to which Ti and/or V is added to control welding penetration depth.

As an example of a technique for improving corrosion resistance of a weld zone, Patent Literature 2 discloses a method in which corrosion resistance is improved by suppressing the precipitation of Cr carbonitrides through the addition of Nb.

Patent Literature 3 discloses a technique in which the corrosion resistance and workability of a weld zone is improved by suppressing the formation of black spots in a weld zone formed by performing TIG welding as a result of optimizing the contents of Al, Ti, Si, and Ca.

PATENT LITERATURE

PTL 1: Japanese Unexamined Patent Application Publication No. 8-170154

PTL 2: Japanese Patent No. 5205951

PTL 3: Japanese Patent No. 5489759

SUMMARY OF THE INVENTION

In the case of conventional ferritic stainless steel sheets, for various applications such as for kitchen apparatus, parts of burning appliances, refrigerator front doors, battery cases, and architectural hardware, it may not be possible to achieve good shape of weld zone. In addition, it may not be possible to achieve good corrosion resistance of a weld zone of different materials welding.

In the applications described above, it is difficult to effectively use the technique disclosed in Patent Literature 1, and there is a risk that it may not be possible to achieve excellent corrosion resistance of a weld zone of different materials. It is also difficult to use the techniques disclosed in Patent Literature 2 and Patent Literature 3, and no consideration is given to suppress the occurrence of weld zone shape defects such as a sag and an undercut in the respective cases of a technique involving steel to which Nb is simply added and a technique in which the formation of black spots is controlled.

An object according to aspects of the present invention is to provide a ferritic stainless steel sheet excellent in shape of weld zone and corrosion resistance of a different materials weld zone by welding with austenitic stainless steel.

The present inventors conducted intensive investigations regarding the influences of the chemical composition of steel on shape of weld zone and the corrosion resistance of a weld zone to solve the problems described above and, as a result, found that it is possible to improve shape of weld zone and to inhibit a deterioration in the corrosion resistance of a weld zone with a material of a different kind by specifying constituent chemical elements of the chemical composition and by optimizing the balance among the contents of Nb, Ti, Zr, Si, and Al. It is possible to realize an improvement in weld zone shape and corrosion resistance of a weld zone with a material of a different kind by optimizing the contents of Ti, Zr, Si, and Al, which have an influence on weld metal flow in a weld zone, and by optimizing the balance among the contents of Nb, Ti, and Zr, which contribute to inhibiting sensitization as a result of forming carbonitrides.

In addition, for various applications such as for kitchen appliances, home electrical appliances, and architectural hardware, there may be a case where work such as forming is performed after welding has been performed and satisfactory designability in the worked state is required. When strain is introduced into a weld zone of a conventional ferritic stainless steel sheet, for example, in the case where the steel sheet is subjected to press forming for the purpose of obtaining a predetermined shape after welding has been performed or in the case where the steel sheet is subjected to light work for the purpose of achieving dimensional precision of parts, it may not be possible to achieve good surface quality. Moreover, in the case where there is a deterioration in surface quality after strain has been introduced into a weld zone, that is, in the case where there is an increase in surface roughness, there is a risk of a deterioration in the corrosion resistance of a weld zone after having been subjected to work. That is, there is room for improvement regarding the surface quality of a weld zone after having been subjected to work.

The present inventors diligently conducted additional investigations regarding the influence of the chemical composition of steel on the surface quality of a weld zone after having been subjected to work such as forming and, as a result, found that it is possible to suppress a deterioration in the surface quality of a weld zone after having been subjected to work such as forming by specifying the chemical composition and by optimizing the combined contents of Ti, Nb, Zr, and Al.

Hereinafter, work such as forming which is performed on a weld zone may simply be referred to as "work on a weld zone".

The present inventors conducted additional investigations and completed the present invention. The subject matter of aspects of the present invention is as follows.

[1] A ferritic stainless steel sheet having a chemical composition containing, by mass %, C: 0.003% to 0.020%,
Si: 0.01% to 1.00%,
Mn: 0.01% to 0.50%,
P: 0.040% or less,
S: 0.010% or less,
Cr: 20.0% to 24.0%,
Cu: 0.20% to 0.80%,
Ni: 0.01% to 0.60%,
Al: 0.01% to 0.08%,
N: 0.003% to 0.020%,
Nb: 0.40% to 0.80%,
Ti: 0.01% to 0.10%,
Zr: 0.01% to 0.10%, and
the balance being Fe and inevitable impurities, in which relational expression (1) below is satisfied:

$$3.0 \geq Nb/(2Ti+Zr+0.5Si+5Al) \geq 1.5 \quad (1),$$

here, in relational expression (1), each of the atomic symbols denotes the content (mass %) of the corresponding chemical element.

[2] The ferritic stainless steel sheet according to item [1], in which relational expression (2) below is satisfied:

$$2Ti+Nb+1.5Zr+3Al \geq 0.75 \quad (2),$$

here, in relational expression (2), each of the atomic symbols denotes the content (mass %) of the corresponding chemical element.

[3] The ferritic stainless steel sheet according to item [1] or [2], in which the chemical composition further contains, by mass %, V: 0.01% to 0.30%.

[4] The ferritic stainless steel sheet according to any one of items [1] to [3], in which the chemical composition further contains, by mass %, one or both of Mo: 0.01% to 0.30% and
Co: 0.01% to 0.30%.

[5] The ferritic stainless steel sheet according to any one of items [1] to [4], in which the chemical composition further contains, by mass %, one or more of B: 0.0003% to 0.0050%,
Ca: 0.0003% to 0.0050%,
Mg: 0.0005% to 0.0050%,
REM: 0.001% to 0.050%,
Sn: 0.01% to 0.50%, and
Sb: 0.01% to 0.50%.

In the case of the ferritic stainless steel sheet according to aspects of the present invention, it is possible to achieve excellent shape of weld zone and to significantly improve the corrosion resistance of a weld zone with a material of different kind formed by performing welding with austenitic stainless steel compared with the case of conventional ferritic stainless steel sheets.

In addition, in the case of the ferritic stainless steel sheet according to preferable embodiments of the present invention, it is possible to significantly improve the surface quality of a weld zone after having been subjected to work compared with the case of conventional ferritic stainless steel sheets. That is, in the case of the ferritic stainless steel sheet according to aspects of the present invention, it is possible to significantly decrease the degree of a deterioration in the surface quality of members which are required to have sufficient designability after having been subjected to work.

As described above, in the case of the ferritic stainless steel sheet according to aspects of the present invention, it is possible to significantly improve the properties of a product thereof, which has a significant effect on the industry.

BRIEF DESCRIPTION OF DRAWINGS

The FIGURE is an observation example of the cross-sectional shape of a weld zone formed by performing TIG welding in an example. A ferritic stainless steel sheet is on the right hand side, and a SUS304 steel sheet is on the left hand side. Observation examples with a sag (A), with an undercut (B), and with excellent shape of weld zone (C) are given.

DETAILED DESCRIPTION OF EMBODIMENTS OF THE INVENTION

Hereafter, the embodiments of the present invention including the most favorable embodiment will be described.

First, the reasons for specifying the chemical composition of the steel according to aspects of the present invention as described above will be described. "%" regarding the chemical composition denotes "mass %", unless otherwise noted.

C: 0.003% to 0.020%

Since C causes a deterioration in the corrosion resistance of a weld zone due to sensitization, it is preferable that the C content be as low as possible. Therefore, in accordance with aspects of the present invention, the C content is set to be 0.020% or less, or preferably 0.015% or less. On the other hand, since steel-making costs increase by excessively decreasing the C content, the lower limit of the C content is set to be 0.003%, or preferably 0.005%.

In addition, since C is a solid-solution-strengthening chemical element which is effective for suppressing the growth of recrystallized grains, there is an increase in the diameter of crystal grains in a weld zone in the case where the C content is excessively low, which results in a deterioration in the surface quality of a weld zone after having been subjected to work. Therefore, to improve the surface quality of a weld zone after having been subjected to work, it is necessary that the C content be 0.003% or more, or preferably 0.005% or more.

Si: 0.01% to 1.00%

Although Si contributes to the deoxidation of steel, it is not possible to realize such an effect in the case where the Si content is less than 0.01%. Therefore, the Si content is set to be 0.01% or more, preferably 0.05% or more, or more preferably 0.10% or more. On the other hand, in the case where the Si content is excessively high and more than 1.00%, a large amount of Si oxides is formed when welding is performed, and the oxides are taken into a weld fusion zone, which results in a negative effect on the corrosion resistance of a weld zone. In addition, since there is an increase in the hardness of steel in the case where the Si content is high, there is a deterioration in workability. Therefore, the Si content is set to be 1.00% or less, preferably 0.50% or less, or more preferably 0.25% or less.

In addition, since Si is a solid-solution-strengthening chemical element which is effective for suppressing the growth of recrystallized grains, there is an increase in the diameter of crystal grains in a weld zone in the case where the Si content is excessively low, which results in a deterioration in the surface quality of a weld zone after having been subjected to work. Therefore, to improve the surface quality of a weld zone after having been subjected to work, it is preferable that the Si content be 0.03% or more, or more preferably 0.05% or more.

Mn: 0.01% to 0.50%

Since Mn has a negative effect on corrosion resistance as a result of forming MnS, the Mn content is set to be 0.50% or less, preferably 0.30% or less, or more preferably 0.25% or less.

Since Mn is a solid-solution-strengthening chemical element, and solid solute Mn existing in steel in a weld zone contributes to an increase in strength, Mn is effective for achieving excellent shape of weld zone by suppressing a weld fusion zone from sagging. However, it is not possible to realize such an effect in the case where the Mn content is less than 0.01%. Therefore, the Mn content is set to be 0.01% or more, preferably 0.05% or more, or more preferably 0.10% or more In addition, since Mn is a solid-solution-strengthening chemical element which is effective for suppressing the growth of recrystallized grains, there is an increase in the diameter of crystal grains in a weld zone in the case where the Mn content is excessively low, which results in a deterioration in the surface quality of a weld zone after having been subjected to work. Therefore, to improve the surface quality of a weld zone after having been subjected to work, it is preferable that the Mn content be 0.03% or more, or more preferably 0.05% or more.

P: 0.040% or less

Since there is a negative effect on corrosion resistance in the case where the P content is more than 0.040%, the P content is set to be 0.040% or less, or preferably 0.030% or less. Since it is desirable that the P content be as low as possible, there is no particular limitation on the lower limit of the P content.

S: 0.010% or less

Since S has a negative effect on corrosion resistance as a result of forming inclusions, that is, MnS, it is desirable that the S content be as low as possible. Therefore, in accordance with aspects of the present invention, the S content is set to be 0.010% or less, preferably 0.0050% or less, or more preferably 0.0040% or less. Since it is desirable that the S content be as low as possible, there is no particular limitation on the lower limit of the S content.

Cr: 20.0% to 24.0%

Cr is a chemical element which improves corrosion resistance and which is indispensable in a ferritic stainless steel sheet. Since such an effect becomes marked in the case where the Cr content is 20.0% or more, the Cr content is set to be 20.0% or more, or preferably 20.5% or more. On the other hand, in the case where the Cr content is more than 24.0%, there is a significant decrease in elongation. Therefore, the Cr content is set to be 24.0% or less, preferably 22.0% or less, or more preferably 21.5% or less.

Cu: 0.20% to 0.80%

Cu contributes to an improvement in corrosion resistance. In addition, since solid solute Cu existing in steel in a weld zone contributes to an increase in strength, Cu is effective for achieving excellent shape of weld zone by suppressing a weld fusion zone from sagging. Such effects are realized in the case where the Cu content is 0.20% or more. Therefore, the Cu content is set to be 0.20% or more, preferably 0.30% or more, or more preferably 0.40% or more. On the other hand, since there is a decrease in elongation in the case where the Cu content is excessively high, the Cu content is set to be 0.80% or less, preferably 0.60% or less, or more preferably 0.50% or less.

Ni: 0.01% to 0.60%

Ni contributes to an improvement in corrosion resistance, and such an effect is realized in the case where the Ni content is 0.01% or more. Therefore, the Ni content is set to be 0.01% or more, preferably 0.05% or more, or more preferably 0.10% or more. On the other hand, since there is a decrease in elongation in the case where the Ni content is excessively high and more than 0.60%, the Ni content is set to be 0.60% or less, or preferably 0.40% or less.

Al: 0.01% to 0.08%

Although Al contributes to the deoxidation of steel, it is not possible to realize such an effect in the case where the Al content is less than 0.01%. Therefore, the Al content is set to be 0.01% or more. On the other hand, in the case where the Al content is excessively high and more than 0.08%, a large amount of Al oxides is formed when welding is performed, and the Al oxides are taken into a weld fusion zone, which results in a negative effect on the corrosion resistance of a weld zone. Therefore, the upper limit of the Al content is set to be 0.08%. It is preferable that the Al content be 0.06% or less, more preferably 0.05% or less, or even more preferably 0.04% or less.

In addition, since Al is a chemical element which suppress the growth of crystal grains in a weld zone through a pinning effect caused by Al-based precipitates, Al is effective for improving the surface quality of a weld zone after having been subjected to work in the case where the Al content is 0.01% or more. Therefore, to improve the surface quality of a weld zone after having been subjected to work, the Al content is set to be 0.01% or more, or preferably 0.02% or more. On the other hand, in the case where the Al content is excessively high, since Al-based inclusions are locally concentrated in a weld zone, inhomogeneous growth of crystal grains occurs. As a result, since an inhomogeneous microstructure, in which coarse crystal grains and fine crystal grains is formed, there is a deterioration in the surface quality of a weld zone after having been subjected to work.

Therefore, to improve the surface quality of a weld zone after having been subjected to work, the upper limit of the Al content is set to be 0.00%, or preferably 0.06%.

N: 0.003% to 0.020%

Since N causes a deterioration in the corrosion resistance of a weld zone due to sensitization, it is desirable that the N content be as low as possible. Therefore, in accordance with aspects of the present invention, the N content is set to be 0.020% or less, or preferably 0.015% or less. On the other hand, since steel-making costs increase by excessively decreasing the N content, the lower limit of the N content is set to be 0.003%, or preferably 0.005%.

In addition, since N is a solid-solution-strengthening chemical element which is effective for inhibiting the growth of recrystallized grains, there is an increase in the diameter of crystal grains in a weld zone in the case where the N content is excessively low, which results in a deterioration in the surface quality of a weld zone after having been subjected to work. Therefore, to improve the surface quality of a weld zone after having been subjected to work, it is necessary that the N content be 0.003% or more, or preferably 0.005% or more.

Nb: 0.40% to 0.80%

Since Nb is a carbonitride-forming chemical element, Nb suppresses a deterioration in the corrosion resistance of a weld zone due to sensitization as a result of fixing C and N. In addition, since solid solute Nb existing in steel in a weld zone contributes to an increase in strength, Nb is effective for achieving excellent shape of weld zone by suppressing a weld fusion zone from sagging. The effects described above are realized in the case where the Nb content is 0.40% or more. Therefore, the Nb content is set to be 0.40% or more, preferably 0.45% or more, or more preferably 0.50% or more. On the other hand, since there is a decrease in elongation in the case where the Nb content is excessively high, the Nb content is set to be 0.80% or less, preferably 0.75% or less, or more preferably 0.70% or less.

In addition, Nb is a chemical element which is effective for suppressing the growth of crystal grains in a weld zone through a pinning effect caused by Nb-based precipitates. Such an effect is realized in the case where the Nb content is 0.40% or more. Therefore, to improve the surface quality of a weld zone after having been subjected to work, the Nb content is set to be 0.40% or more, or preferably 0.55% or more.

Ti: 0.01% to 0.10%

Since Ti is, like Nb, a carbonitride-forming chemical element, Ti suppresses a deterioration in the corrosion resistance of a weld zone due to sensitization as a result of fixing C and N. In addition, since solid solute Ti existing in steel in a weld zone contributes to an increase in strength, Ti is effective for achieving excellent shape of weld zone by suppressing a weld fusion zone from sagging. The effects described above are realized in the case where the Ti content is 0.01% or more. Therefore, the Ti content is set to be 0.01% or more. On the other hand, since surface defects due to inclusions occur in the case where the Ti content is more than 0.10%, the upper limit of the Ti content is set to be 0.10%. It is preferable that the Ti content be 0.05% or less, or more preferably 0.04% or less.

In addition, Ti is a chemical element which is effective for suppressing the growth of crystal grains in a weld zone through a pinning effect caused by Ti-based precipitates. To improve the surface quality of a weld zone after having been subjected to work, the Ti content is set to be 0.01% or more, or preferably 0.02% or more. On the other hand, in the case where the Ti content is excessively high, since Ti-based inclusions are locally concentrated in a weld zone, inhomogeneous growth of crystal grains occurs. As a result, since an inhomogeneous microstructure, in which coarse crystal grains and fine crystal grains coexist, is formed, there is a deterioration in the surface quality of a weld zone after having been subjected to work. Therefore, to improve the surface quality of a weld zone after having been subjected to work, the Ti content is set to be 0.10% or less, preferably 0.08% or less, more preferably 0.06% or less, or even more preferably 0.04% or less.

Zr: 0.01% to 0.10%

Since Zr is, like Nb and Ti, a carbonitride-forming chemical element, Zr suppresses a deterioration in the corrosion resistance of a weld zone due to sensitization as a result of fixing C and N. In addition, since solid solute Zr existing in steel in a weld zone contributes to an increase in strength, Zr is effective for achieving excellent shape of weld zone by suppressing a weld fusion zone from sagging. The effects described above are realized in the case where the Zr content is 0.01% or more. Therefore, the Zr content is set to be 0.01% or more. On the other hand, since surface defects due to inclusions occur in the case where the Zr content is more than 0.10%, the upper limit of the Zr content is set to be 0.10%, Or preferably 0.05%.

Zr is a chemical element which is important for achieving good surface quality of a weld zone. Zr suppresses crystal grains from excessively growing as a result of being finely precipitated in a cooling process starting at the time of solidification in a weld fusion zone. With this, Zr contributes to achieving good surface quality of a weld zone after having been subjected to work. To realize such an effect, the Zr content is set to be 0.01% or more, or preferably 0.02% or more. On the other hand, in the case where the Zr content is excessively high, since Zr-based inclusions are locally concentrated in a weld zone, inhomogeneous growth of crystal grains occurs, which results in an inhomogeneous microstructure, in which coarse crystal grains and fine crystal grains coexist, being formed. As a result, not only surface defects occur after welding has been performed, but also there is a deterioration in the surface quality of a weld zone after having been subjected to work. Therefore, the Zr content is set to be 0.10% or less, preferably 0.08% or less, or more preferably 0.06% or less.

Ti and Zr are chemical elements which form carbonitrides in steel and which improve the corrosion resistance of a weld zone with a material of a different kind formed by performing welding with austenitic stainless steel. Therefore, to achieve sufficient corrosion resistance of a weld zone, it is preferable that the contents of Ti and Zr be equal to or more than certain amounts. Moreover, by adding Ti and Zr not separately but in combination, since it is possible to finely disperse precipitates in Weld metal by suppressing the formation of coarse Ti-based precipitates through the formation of Zr-based precipitates, it is possible to achieve the good corrosion resistance. Since Nb is also important regarding the corrosion resistance of a weld zone with a material of a different kind formed by performing welding with austenitic stainless steel, it is necessary that Nb be added in a predetermined amount. In particular, to achieve unprecedentedly excellent corrosion resistance of a weld zone of materials of different kinds, Nb, which forms carbides later than Zr and Ti in the cooling and solidification process of weld fusion metal, is important.

The basic chemical composition is described above, and the chemical elements described below may be further added in accordance with aspects of the present invention.

V: 0.01% to 0.30%

Since V is a carbonitride-forming chemical element, V suppresses a deterioration in the corrosion resistance of a weld zone due to sensitization. To realize such an effect, it is preferable that the V content be 0.01% or more. On the other hand, since there is a deterioration in workability in the case where the V content is excessively high, it is preferable that the upper limit of the V content be 0.30%, or more preferably 0.20%.

Mo: 0.01% to 0.30%

Mo is effective for improving corrosion resistance. In addition, since solid solute Mo existing in steel in a weld zone contributes to an increase in strength, Mo is effective for achieving excellent shape of weld zone by suppressing a weld fusion zone from sagging. To realize such effects, it is preferable that the Mo content be 0.01% or more. On the other hand, since there is a decrease in elongation in the case where the Mo content is excessively high, it is preferable that the Mo content be 0.30% or less, more preferably 0.20% or less, or even more preferably 0.15% or less.

Co: 0.01% to 0.30%

Co is effective for improving corrosion resistance. In addition, since solid solute Co existing in steel in a weld zone contributes to an increase in strength, Co is effective for achieving excellent shape of weld zone by suppressing a weld fusion zone from sagging. To realize such effects, it is preferable that the Co content be 0.01% or more. On the other hand, since there is a decrease in elongation in the case where the Co content is excessively high, it is preferable that the Co content be 0.30% or less, more preferably 0.20% or less, or even more preferably 0.15% or less.

B: 0.0003% to 0.0050%

B is a chemical element which improves hot workability and secondary workability, and it is preferable that the B content be 0.0003% or more, or more preferably 0.0010% or more, to realize such an effect. In the case where the B content is more than 0.0050%, there is a risk of a deterioration in toughness. Therefore, it is preferable that the B content be 0.0050% or less, or more preferably 0.0030% or less. [0057]

Ca: 0.0003% to 0.0050%

Ca is a chemical element which is effective for deoxidation, and it is preferable that the Ca content be 0.0003% or more, or more preferably 0.0005% or more, to realize such an effect. In the case where the Ca content is more than 0.0050%, there is a risk of a deterioration in corrosion resistance. Therefore, it is preferable that the Ca content be 0.0050% or less, or more preferably 0.0020% or less.

Mg: 0.0005% to 0.0050%

Mg contributes the deoxidizing of steel. To realize such an effect, it is preferable that the Mg content be 0.0005% or more, or more preferably 0.0010% or more. In the case where the Mg content is more than 0.0050%, there is a risk of a deterioration in manufacturability due to a deterioration in the toughness of steel. Therefore, it is preferable that the Mg content be 0.0050% or less, or more preferably 0.0030% or less.

REM (rare-earth metal): 0.001% to 0.050%

REM (rare-earth metal: one of the chemical elements having atomic numbers of 57 through 71 such as La, Ce, and Nd) is a chemical element which improves high-temperature oxidation resistance. To realize such an effect, it is preferable that the REM content be 0.001% or more, or more preferably 0.005% or more. In the case where the REM content is more than 0.050%, there is a risk that surface defects may occur when hot rolling is performed. Therefore, it is preferable that the REM content be 0.050% or less, or more preferably 0.030% or less.

Sn: 0.01% to 0.50%

Sn is effective for suppressing surface roughening due to work from occurring by promoting the formation of a deformation zone when rolling is performed. To realize such an effect, it is preferable that the Sn content be 0.01% or more, or more preferably 0.03% or more. In the case where the Sn content is more than 0.50%, there is a risk of a deterioration in workability. Therefore, it is preferable that the Sn content be 0.50% or less, or more preferably 0.20% or less.

Sb: 0.01% to 0.50%

Sb is, like Sn, effective for suppressing surface roughening due to work from occurring by promoting the formation of a deformation zone when rolling is performed. To realize such an effect, it is preferable that the Sb content be 0.01% or more, or more preferably 0.03% or more. In the case where the Sb content is more than 0.50%, there is a risk of a deterioration in workability. Therefore, it is preferable that the Sb content be 0.50% or less, or more preferably 0.20% or less.

In the chemical composition, the balance is Fe and inevitable impurities.

The requirement of aspects of the present invention is not satisfied only by the fact that each of the constituent chemical elements satisfies the requirement regarding the range of its content described above, and it is also necessary that relational expression (1) below be satisfied. Here, in relational expression (1), each of the atomic symbols denotes the content (mass %) of the corresponding chemical element.

$$3.0 \geq Nb/(2Ti+Zr+0.5Si+5Al) \geq 1.5 \quad (1)$$

Relational expression (1) above relates to the condition necessary for achieving excellent shape of weld zone without shape defects such as a sag and an undercut in a weld fusion zone by controlling the balance among the contents of Nb, Ti, Zr, Si, and Al. The coefficients in relational expression (1) above are empirically derived.

Although a detailed reason is not clear, there is a tendency for a weld fusion zone to sag in the case where the Nb content is low.

Solid solute Nb existing in steel in a cooling process starting at the time of solidification in a weld fusion zone contributes to an increase in strength.

Therefore, it is considered that, in the case where the Nb content is low, a sag occurs in a weld fusion zone due to the high-temperature strength of the weld fusion zone being low. In addition, Ti, Zr, Si, and Al are chemical elements which tend to form oxides. In the case where the contents of Ti, Zr, Si, and Al are excessively high, formed oxides may cause shape defects in a weld fusion zone by deteriorating the fluidity of fusion metal. In particular, there may be a case where an undercut occurs at the interface between an austenitic stainless steel sheet and fusion metal when welding is performed between materials of different kinds. Therefore, to achieve excellent shape of weld zone, it is preferable that the total content of Ti, Zr, Si, and Al be low with the Nb content being high. In the case where the calculated value in relational expression (1) is less than 1.5, the occurrence of the shape defects of a weld zone becomes marked. In contrast, in the case where the calculated value in relational expression (1) is 1.5 or more, excellent weld zone shape is achieved. Therefore, the calculated value in relational expression (1) is set to be 1.5 or more, or preferably 1.6 or more.

In the case where the contents of Ti, Zr, Si, and Al are excessively low, there is a decrease in the amount of precipitates formed in a cooling process starting at the time of solidification in a weld fusion zone. That is, there is coarsening of crystal grains due to a decrease in the amount of precipitates, which have a pinning effect. Moreover, since there is a decrease in the amount of solid solute Nb in steel due to an increase in the amount of Nb precipitates, there is a decrease in the high-temperature strength of a weld fusion zone. It is considered that a sag occurs in a weld fusion zone for the reasons described above. In addition, in the case where the Nb content is excessively high, there may be a case where the shape defects of a weld fusion zone occur. In particular, there may be a case where an undercut occurs at the interface between an austenitic stainless steel sheet and fusion metal when welding is performed between materials of different kinds. Although a detailed reason is not clear, it is considered that, since there are influences on fusion metal flow and wettability with a base metal through the surface tension of molten steel and the stability of arc in a weld pool, shape defects in weld fusion zone occur. Therefore, to achieve excellent weld zone shape, it is preferable that the total content of Ti, Zr, Si, and Al be appropriately high without the Nb content being excessively high. In the case where the calculated value in relational expression (1) is more than 3.0, the occurrence of the shape defects of a weld zone becomes marked. In contrast, in the case where the calculated value in relational expression (1) is 3.0 or less, excellent shape of weld zone is achieved. Therefore, the calculated value in relational expression (1) is set to be 3.0 or less, preferably 2.9 or less, or more preferably 2.8 or less.

In accordance with aspects of the present invention, by satisfying relational expression (2) below after having satisfied relational expression (1) above, it is possible to realize excellent surface quality of a weld zone after having been subjected to work. Here, in relational expression (2), each of the atomic symbols denotes the content (mass %) of the corresponding chemical element.

$$2Ti+Nb+1.5Zr+3Al \geq 0.75 \quad (2)$$

Relational expression (2) above is effective for achieving good surface quality in a weld zone after having been subjected to work. In the case where the calculated value in relational expression (2) above is less than 0.75, there is an insufficient improvement in the surface quality of a weld zone after having been subjected to work. In contrast, in the case where the calculated value in relational expression (2) above is 0.75 or more, excellent surface quality of a weld zone after having been subjected to work is achieved. It is preferable that the calculated value in relational expression (2) be 0.80 or more. On the other hand, to suppress hardness from excessively increasing and to achieve good elongation, it is preferable that the upper limit of the calculated value in relational expression (2) be 1.00.

Ti, Nb, Zr, and Al may be precipitated in steel in the form of carbonitrides and oxides. The precipitates improve the homogeneity of a microstructure in a weld zone because of a pinning effect.

However, in the case of steel to which Ti is simply added, the following problems may occur in a weld fusion zone. That is, Ti-based precipitates which start to be precipitated at a high temperature and then combine with each other to have a large diameter, and Ti-based precipitates which are precipitated at a low temperature during a cooling process to have a small diameter, coexist. Since the Ti-based precipitates combined to have a large diameter and the Ti-based precipitates having a small diameter have different influence on grain growth, a mixed-grain microstructure having variations in crystal grain diameter, in which grains having a large diameter and grains having a small diameter coexist, is formed, which results in a deterioration in the surface quality of a weld zone after having been subjected to work.

In addition, in the case of steel to which Nb is simply added, Nb starts to be precipitated at a lower temperature than that at which Ti does. Therefore, it is expected that a pinning effect caused by Nb-based precipitates having a small diameter is realized in a lower temperature range than that in which Ti starts to be precipitated. However, since it is not expected that the pinning effect caused by the precipitates is realized in a high temperature range in which Nb is not precipitated, a certain amount of crystal grains having a large diameter is formed, which results in a deterioration in the surface quality of a weld zone after having been subjected to work.

In the case of steel to which Zr is simply added, Zr, like Ti, starts to be precipitated at a high temperature. Therefore, as in the case of steel to which Ti is simply added, steel to which Zr is simply added has a mixed-grain microstructure having variations in crystal grain diameter, in which grains having a large diameter and grains having a small diameter coexist, which results in a deterioration in the surface quality of a weld zone after having been subjected to work.

In the case of steel to which Al is simply added, Al starts to be precipitated at a lower temperature than that at which Ti does as in the case of steel to which Nb is simply added. Therefore, also in the case of steel to which Al is simply added, since it is not expected that a pinning effect caused by precipitates is realized in a high temperature range, a certain amount of coarsened crystal grains is formed, which results in a deterioration in the surface quality of a weld zone after having been subjected to work.

Moreover, in the case where predetermined amounts of Ti, Nb, Zr, and Al are not added and, accordingly, the amount of precipitates is very small, since a certain amount or more of precipitates are not homogeneously dispersed and precipitated in steel, there are regions in which precipitates are locally concentrated. As a result, a mixed-grain microstructure having variations in distribution of precipitates and in crystal grain diameter is formed.

In the case where a weld zone has an inhomogeneous mixed-grain microstructure, there are regions having many crystal grain boundaries and regions having only a few crystal grain boundaries. In this case, since strain introduced by work is concentrated at crystal grain boundaries and within some of the crystal grains, homogeneous deformation does not occur, which makes it difficult to achieve good surface quality.

On the other hand, by adding Ti, Nb, Zr, and Al in combination, it is possible to more homogeneously disperse a certain amount or more of precipitates in a cooling process of a weld zone. As a result, it is possible to form a microstructure having relatively uniform distribution of precipitates and relatively uniform crystal grain diameter. The coefficients in relational expression (2) above are derived from experimental results and in consideration of the affinities of these chemical elements for oxygen and nitrogen.

The ferritic stainless steel sheet according to aspects of the present invention can suitably be used in applications involving various kinds of work such as tensile work, bending work, drawing, and bulging. Although there is no particular limitation on the thickness of the steel sheet, the thickness may usually be 0.10 mm to 6.0 mm.

In addition, the ferritic stainless steel sheet according to aspects of the present invention can suitably be used in applications involving welding. There is no particular limitation on the conditions used for welding, and the conditions may be determined as needed. It is preferable that welding be performed by using a TIG welding method. In addition, a welded member, which is formed by combining a ferritic stainless steel sheet and an austenitic stainless steel sheet, is manufactured by performing TIG welding. Therefore, above-mentioned TIG welding may also be a method for manufacturing a welded member according to aspects of the present invention. Although the condition used for performing TIG welding may be appropriately decided, an example of a preferable condition is as follows.

welding voltage: 8 V to 15 V welding current: 50 A to 250 A welding speed: 100 mm/min to 1000 ram/min electrode: tungsten electrode having a diameter of 1 mm ϕ to 5 mmϕ shielding gas (Ar gas) on the back and front sides: 5 L/min to 40 L/min

It is preferable that, for example, SUS304, SUS304L, SUS316, or SUS316L be used as an austenitic stainless steel sheet for TIG welding described above. SUS 304 is used in examples below. Since SUS304 has weldability similar to that of other three kinds of austenitic stainless steel, it is reasonably presumed that the effects of aspects of the present invention which is realized by using SUS304 is also realized by using other kinds of austenitic stainless steel sheets.

Here, the ferritic stainless steel sheet according to aspects of the present invention may be used for welding with a material of the same kind or a material of a different kind, that is, stainless steel such as austenitic stainless steel, martensitic stainless steel, precipitation hardening stainless steel, or duplex stainless steel.

There is no particular limitation on the method used for manufacturing the ferritic stainless steel sheet according to aspects of the present invention. Hereafter, a preferable method for manufacturing the ferritic stainless steel sheet, in particular, the cold-rolled ferritic stainless steel sheet, according to aspects of the present invention will be described.

After molten steel having the chemical composition described above has been prepared by using a known method such as one using a converter, an electric furnace, or a vacuum melting furnace, secondary refining is performed by using, for example, a VOD (Vacuum Oxygen Decarburization) method. Subsequently, a steel material (slab) is manufactured by using a continuous casting method or an ingot-casting-slabbing method. This steel material is heated to a temperature of 1000° C. to 1250° C., and then hot-rolled to have a thickness of 2.0 mm to 8.0 mm with a finishing delivery temperature of 700° C. to 1050° C. The hot-rolled steel sheet manufactured as described above is annealed at a temperature of 850° C. to 1100° C., pickled, cold-rolled, and then subjected to cold-rolled-sheet annealing at a temperature of 800° C. to 1050° C. After cold-rolled-sheet annealing has been performed, pickling is performed to remove scale. The cold-rolled steel sheet which has been subjected to scale removal may be subjected to skin pass rolling.

EXAMPLES

Hereafter, the present invention will be specifically described on the basis of examples. The scope of the present invention is not limited to the examples below.

Molten steels having the chemical compositions (with the balance being Fe and inevitable impurities) given in Tables 1 through 3 were prepared by using a small vacuum melting furnace and made into 50-kg steel ingots. These ingots were heated to a temperature of 1200° C. and hot-rolled into hot-rolled steel sheets having a thickness of 4.0 mm. Subsequently, the hot-rolled steel sheets were subjected to hot-rolled-sheet annealing in which the hot-rolled steel sheets were held at a temperature of 1050° C. for 60 seconds, pickled, cold-rolled into cold-rolled steel sheets having a thickness of 1.0 mm, and subjected to cold-rolled-sheet annealing in which the cold-rolled steel sheets were held at a temperature of 950° C. for 30 seconds. After having been subjected to polishing to remove scale on the surface, the cold-rolled steel sheets were polished to a #600 finish by using emery paper and used as sample materials.

A test piece having a side length in the rolling direction (L-direction) of 200 mm and a side length in a direction (C-direction) perpendicular to the rolling direction of 90 mm was taken from each of the steel sheets obtained as described above. The test piece was welded with a sheet of SUS304 having a thickness of 1.0 mm, a side length in the rolling direction of 200 mm, and a side length in a direction perpendicular to the rolling direction of 90 mm to form a butt-welded joint, the mutual sides having a length of 200 mm of the test piece and the sheet of SUS 304 being butted by performing TIG welding at a welding voltage of 10 V, a welding current of 90 A to 110 A, and a welding speed of 600 mm/min, with a tungsten electrode having a diameter of 1.6 mmϕ, and front and back shielding gas (Ar gas) at a flow rate of 20 L/min. Therefore, the welding direction (the direction of the weld bead) was parallel to the rolling direction.

(1) Shape of Weld Zone

A test piece having a thickness of 1.0 mm, a width of 15 mm, and a length of 10 mm was taken from the butt-welded joint obtained as described above so that the length direction of the test piece was parallel to the welding direction and the weld bead was at the center in the width direction, and the cross section of the test piece perpendicular to the welding direction was observed after having been etched by using aqua regia. A case where a weld fusion zone had a part being 0.15 mm or more lower than the positions of the base metals butted on the right- and left-hand sides thereof was judged as a case of a sag (refer to the FIGURE at section (A) "SAG"). In addition, a case where the thickness of a weld fusion zone at the position where the weld fusion zone is in contact with the base metal was 0.15 mm or more thinner than that of the base metal was judged as a case of an undercut (refer to the FIGURE at section (B) "WITH UNDERCUT"). A case of a sag or a case of an undercut was judged as a case of insufficient shape of weld zone "x". On the other hand, a case which was not judged as a case of unsatisfactory weld zone shape was judged as a case of good weld zone shape "O" (refer to the FIGURE at section (C) "EXCELLENT IN SHAPE OF WELD ZONE"). The results are given in the column "Weld Zone Shape" in Tables 1 through 3.

(2) Corrosion Resistance of Weld Zone

A test piece having a thickness of 1.0 mm, a width of 60 mm, and a length of 80 mm was taken from the butt-welded joint so that the length direction of the test piece was parallel to the welding direction and the weld bead was on the whole central line in the width direction, the front surface (on the side of the electrode at the time of welding) of the test piece was polished by using #600 emery paper, the whole back surface and the regions having a width of 5 mm measured from the outer circumferential edges of the test piece were sealed, and the test piece was subjected to a combined cyclic corrosion test in such a manner that a unit corrosion test cycle was repeated 30 times, where the unit corrosion test cycle consisted of salt spraying (35° C., 5% NaCl, 2 hours), drying (60° C., 4 hours), and wetting (50° C., 4 hours), to determine a rusted area ratio in a surface region having a width of 20 mm with the weld bead on the central line of the surface region. A case where the rusted area ratio was 10% or less was judged as a case of good corrosion resistance of a weld zone "O". A case where the rusted area ratio was more than 10% was judged as a case of unsatisfactory corrosion resistance of a weld zone "x". The results are given in the column "Corrosion Resistance" in Tables 1 through 3.

(3) Surface Quality of Weld Zone after having been Subjected to Work

A JIS No. 5 tensile test piece was taken from the butt-welded joint so that the tensile direction was perpendicular to the welding direction and the weld bead was at the center in the length direction of the test piece, the surface of the test piece was polished by using #600 emery paper, the polished test piece was subjected to a tensile plastic strain of 20%, and the maximum height roughness Rz in the welding direction in a weld zone was determined. The term "weld zone" refers to a weld fusion metal zone and a welded heat affected zone.

A case where the maximum height roughness Rz in a weld zone after applying tensile stress was 10 μm or less was judged as a case of excellent surface quality "O". A case where the maximum height roughness Rz in a weld zone after applying tensile stress was more than 10 μm was judged as a case of no marked improvement in surface quality "x". The results of the test of surface quality are given in the column "Surface Quality" in Tables 1 through 3. Here, the maximum height roughness Rz was determined in accordance with JIS B 0601 (2013). The length of determination was 5 mm, the determination was performed three times for each sample, and the simple average value of the three determined values was defined as the maximum height roughness Rz of the sample.

As indicated in Tables 1 through 3, all of the example steels of the present invention had excellent shape of weld zone and excellent corrosion resistance of a weld zone of materials of different kinds. Moreover, in the case where relational expression (2) was also satisfied, the surface quality of a weld zone after having been subjected to work was also excellent. In contrast, the comparative steels, which were outside the range of the present invention, were poor in shape of weld zone or the corrosion resistance of a weld zone or both properties.

TABLE 1

| Steel | Chemical Composition (mass %) | | | | | | | | | | | | | |
|---|---|---|---|---|---|---|---|---|---|---|---|---|---|---|
| Grade | C | Si | Mn | P | S | Cr | Cu | Ni | Al | N | Nb | Ti | Zr | Other |
| A1 | 0.009 | 0.13 | 0.14 | 0.025 | 0.0027 | 21.1 | 0.42 | 0.41 | 0.03 | 0.007 | 0.55 | 0.01 | 0.01 | — |
| A2 | 0.008 | 0.08 | 0.16 | 0.027 | 0.0023 | 21.9 | 0.63 | 0.45 | 0.02 | 0.009 | 0.54 | 0.01 | 0.03 | — |
| A3 | 0.015 | 0.19 | 0.47 | 0.022 | 0.0018 | 23.8 | 0.55 | 0.33 | 0.02 | 0.015 | 0.61 | 0.01 | 0.01 | V: 0.08 |
| A4 | 0.009 | 0.17 | 0.15 | 0.014 | 0.0035 | 20.9 | 0.41 | 0.28 | 0.02 | 0.008 | 0.54 | 0.01 | 0.02 | Mo: 0.15 |
| A5 | 0.019 | 0.22 | 0.31 | 0.033 | 0.0071 | 21.3 | 0.43 | 0.55 | 0.02 | 0.006 | 0.47 | 0.01 | 0.07 | Mg: 0.0011 |
| A6 | 0.017 | 0.15 | 0.17 | 0.035 | 0.0044 | 21.5 | 0.41 | 0.32 | 0.02 | 0.012 | 0.57 | 0.02 | 0.01 | Ca: 0.0015 |
| A7 | 0.014 | 0.05 | 0.19 | 0.024 | 0.0015 | 20.4 | 0.32 | 0.21 | 0.03 | 0.009 | 0.49 | 0.04 | 0.02 | Sn: 0.19 |
| A8 | 0.011 | 0.07 | 0.21 | 0.028 | 0.0032 | 21.9 | 0.44 | 0.44 | 0.02 | 0.006 | 0.52 | 0.03 | 0.02 | Sb: 0.15 |
| A9 | 0.012 | 0.14 | 0.11 | 0.029 | 0.0057 | 21.2 | 0.36 | 0.32 | 0.01 | 0.008 | 0.47 | 0.08 | 0.01 | B: 0.0025 |
| A10 | 0.008 | 0.33 | 0.13 | 0.032 | 0.0034 | 22.4 | 0.26 | 0.41 | 0.02 | 0.011 | 0.61 | 0.01 | 0.01 | Co: 0.11 |
| A11 | 0.006 | 0.03 | 0.15 | 0.025 | 0.0025 | 22.1 | 0.33 | 0.35 | 0.01 | 0.007 | 0.41 | 0.09 | 0.01 | REM: 0.0025 |
| A12 | 0.004 | 0.15 | 0.14 | 0.021 | 0.0018 | 21.9 | 0.27 | 0.36 | 0.02 | 0.005 | 0.52 | 0.03 | 0.03 | — |
| A13 | 0.009 | 0.13 | 0.17 | 0.016 | 0.0035 | 22.3 | 0.42 | 0.18 | 0.02 | 0.009 | 0.58 | 0.02 | 0.02 | V: 0.16, Mo: 0.05 |
| A14 | 0.012 | 0.09 | 0.22 | 0.013 | 0.0061 | 20.7 | 0.38 | 0.25 | 0.03 | 0.012 | 0.57 | 0.01 | 0.01 | V: 0.05, Mg: 0.0015 |
| A15 | 0.011 | 0.18 | 0.46 | 0.027 | 0.0022 | 21.8 | 0.39 | 0.16 | 0.02 | 0.014 | 0.56 | 0.01 | 0.04 | Mo: 0.05, Mg: 0.0012 |
| A16 | 0.014 | 0.22 | 0.23 | 0.024 | 0.0014 | 21.5 | 0.43 | 0.44 | 0.01 | 0.008 | 0.57 | 0.01 | 0.05 | Mo: 0.16, Co: 0.05, Mg: 0.0024 |
| A17 | 0.008 | 0.25 | 0.15 | 0.035 | 0.0026 | 21.1 | 0.45 | 0.22 | 0.02 | 0.009 | 0.58 | 0.01 | 0.03 | V: 0.04, Mo: 0.04, Co: 0.06, B: 0.0007, Ca: 0.0008, Mg: 0.0011, REM: 0.0018, Sn: 0.07, Sb: 0.09 |
| A18 | 0.009 | 0.15 | 0.15 | 0.025 | 0.0031 | 20.9 | 0.42 | 0.21 | 0.02 | 0.008 | 0.55 | 0.01 | 0.01 | V: 0.03, Mo: 0.05, Ca: 0.0005 |

| Steel Grade | Relational Expression (1) | Relational Expression (2) | Shape of Weld Zone | Corrosion Resistance | Surface Quality | Note |
|---|---|---|---|---|---|---|
| A1 | 2.2 | 0.68 | ○ | ○ | x | Example Steel |
| A2 | 2.8 | 0.67 | ○ | ○ | x | Example Steel |
| A3 | 2.7 | 0.71 | ○ | ○ | x | Example Steel |

TABLE 1-continued

| | | | | | | |
|---|---|---|---|---|---|---|
| A4 | 2.4 | 0.65 | ○ | ○ | x | Example Steel |
| A5 | 1.6 | 0.66 | ○ | ○ | x | Example Steel |
| A6 | 2.5 | 0.69 | ○ | ○ | x | Example Steel |
| A7 | 1.8 | 0.69 | ○ | ○ | x | Example Steel |
| A8 | 2.4 | 0.67 | ○ | ○ | x | Example Steel |
| A9 | 1.6 | 0.68 | ○ | ○ | x | Example Steel |
| A10 | 2.1 | 0.71 | ○ | ○ | x | Example Steel |
| A11 | 1.6 | 0.64 | ○ | ○ | x | Example Steel |
| A12 | 2.0 | 0.69 | ○ | ○ | x | Example Steel |
| A13 | 2.6 | 0.71 | ○ | ○ | x | Example Steel |
| A14 | 2.5 | 0.70 | ○ | ○ | x | Example Steel |
| A15 | 2.2 | 0.70 | ○ | ○ | x | Example Steel |
| A16 | 2.5 | 0.70 | ○ | ○ | x | Example Steel |
| A17 | 2.1 | 0.71 | ○ | ○ | x | Example Steel |
| A18 | 2.7 | 0.65 | ○ | ○ | x | Example Steel |

TABLE 2

| Steel | Chemical Composition (mass %) | | | | | | | | | | | | | |
|---|---|---|---|---|---|---|---|---|---|---|---|---|---|---|
| Grade | C | Si | Mn | P | S | Cr | Cu | Ni | Al | N | Nb | Ti | Zr | Other |
| B1 | 0.011 | 0.17 | 0.15 | 0.022 | 0.0018 | 21.2 | 0.38 | 0.22 | 0.05 | 0.005 | 0.65 | 0.01 | 0.01 | — |
| B2 | 0.004 | 0.08 | 0.22 | 0.033 | 0.0021 | 20.4 | 0.41 | 0.25 | 0.04 | 0.008 | 0.59 | 0.05 | 0.04 | — |
| B3 | 0.015 | 0.04 | 0.31 | 0.038 | 0.0015 | 22.5 | 0.44 | 0.31 | 0.05 | 0.011 | 0.63 | 0.05 | 0.01 | V: 0.14 |
| B4 | 0.017 | 0.09 | 0.45 | 0.027 | 0.0018 | 23.2 | 0.51 | 0.19 | 0.05 | 0.015 | 0.58 | 0.03 | 0.01 | Mo: 0.16 |
| B5 | 0.018 | 0.12 | 0.38 | 0.015 | 0.0019 | 23.8 | 0.63 | 0.28 | 0.05 | 0.012 | 0.66 | 0.02 | 0.09 | Mg: 0.0011 |
| B6 | 0.013 | 0.05 | 0.29 | 0.011 | 0.0015 | 23.5 | 0.57 | 0.37 | 0.02 | 0.009 | 0.54 | 0.09 | 0.01 | Ca: 0.0018 |
| B7 | 0.012 | 0.26 | 0.18 | 0.013 | 0.0023 | 23.3 | 0.44 | 0.46 | 0.04 | 0.008 | 0.64 | 0.01 | 0.01 | Sn: 0.08 |
| B8 | 0.008 | 0.05 | 0.04 | 0.022 | 0.0027 | 22.8 | 0.46 | 0.55 | 0.05 | 0.007 | 0.57 | 0.02 | 0.01 | Sb: 0.02 |
| B9 | 0.006 | 0.06 | 0.06 | 0.026 | 0.0029 | 22.5 | 0.32 | 0.34 | 0.04 | 0.005 | 0.69 | 0.05 | 0.01 | B: 0.0008 |
| B10 | 0.005 | 0.36 | 0.09 | 0.029 | 0.0035 | 22.1 | 0.41 | 0.21 | 0.03 | 0.003 | 0.68 | 0.02 | 0.05 | Co: 0.15 |
| B11 | 0.007 | 0.24 | 0.11 | 0.035 | 0.0046 | 21.8 | 0.39 | 0.18 | 0.04 | 0.004 | 0.69 | 0.04 | 0.02 | REM: 0.0015 |
| B12 | 0.009 | 0.11 | 0.13 | 0.032 | 0.0051 | 21.9 | 0.29 | 0.33 | 0.04 | 0.006 | 0.75 | 0.01 | 0.03 | Mo: 0.26 |
| B13 | 0.014 | 0.13 | 0.15 | 0.029 | 0.0042 | 21.5 | 0.22 | 0.51 | 0.04 | 0.009 | 0.62 | 0.02 | 0.04 | V: 0.02, Mo: 0.06 |
| B14 | 0.016 | 0.12 | 0.18 | 0.025 | 0.0037 | 21.6 | 0.25 | 0.22 | 0.04 | 0.011 | 0.61 | 0.04 | 0.04 | V: 0.06, Mg: 0.0015 |
| B15 | 0.006 | 0.09 | 0.21 | 0.022 | 0.0034 | 21.2 | 0.39 | 0.33 | 0.04 | 0.012 | 0.65 | 0.02 | 0.03 | V: 0.15, Ca: 0.0012, Mg: 0.0008 |
| B16 | 0.004 | 0.14 | 0.24 | 0.019 | 0.0031 | 21.1 | 0.41 | 0.25 | 0.03 | 0.008 | 0.61 | 0.05 | 0.01 | Mo: 0.15, Ca: 0.0015 |
| B17 | 0.009 | 0.06 | 0.12 | 0.015 | 0.0029 | 20.9 | 0.35 | 0.24 | 0.05 | 0.007 | 0.57 | 0.02 | 0.04 | V: 0.05, Mo: 0.05, Co: 0.05, B: 0.0015, Ca: 0.0007, Mg: 0.0006, REM: 0.0022, Sn: 0.09, Sb: 0.08 |
| B18 | 0.012 | 0.21 | 0.14 | 0.013 | 0.0027 | 20.8 | 0.41 | 0.17 | 0.04 | 0.005 | 0.61 | 0.03 | 0.02 | Mg: 0.0007 |
| B19 | 0.014 | 0.25 | 0.16 | 0.011 | 0.0025 | 20.5 | 0.49 | 0.19 | 0.04 | 0.003 | 0.69 | 0.02 | 0.04 | Mo: 0.08, Mg: 0.0006, Sn: 0.07 |
| B20 | 0.018 | 0.15 | 0.18 | 0.011 | 0.0015 | 20.3 | 0.56 | 0.21 | 0.05 | 0.004 | 0.58 | 0.01 | 0.03 | Mg: 0.0013, Sb: 0.03 |
| B21 | 0.019 | 0.44 | 0.33 | 0.011 | 0.0021 | 20.9 | 0.43 | 0.23 | 0.03 | 0.006 | 0.72 | 0.01 | 0.01 | Ca: 0.0004, Mg: 0.0022, Sb: 0.03 |

TABLE 2-continued

| | | | | | | | | | | | | | | |
|---|---|---|---|---|---|---|---|---|---|---|---|---|---|---|
| B22 | 0.017 | 0.15 | 0.47 | 0.017 | 0.0016 | 21.1 | 0.41 | 0.25 | 0.05 | 0.008 | 0.65 | 0.02 | 0.02 | V: 0.22, Ca: 0.0016, Mg: 0.0018, Sb: 0.05 |
| B23 | 0.018 | 0.08 | 0.39 | 0.019 | 0.0015 | 21.6 | 0.37 | 0.15 | 0.04 | 0.011 | 0.58 | 0.04 | 0.01 | V: 0.06, B: 0.0036, Ca: 0.0022, Mg: 0.0035 |
| B24 | 0.011 | 0.11 | 0.26 | 0.022 | 0.0018 | 21.2 | 0.41 | 0.32 | 0.04 | 0.013 | 0.69 | 0.02 | 0.02 | Co: 0.25 |
| B25 | 0.003 | 0.07 | 0.17 | 0.026 | 0.0029 | 21.4 | 0.44 | 0.04 | 0.04 | 0.009 | 0.57 | 0.06 | 0.01 | Mo: 0.16, REM: 0.0045 |
| B26 | 0.011 | 0.12 | 0.12 | 0.025 | 0.0035 | 21.1 | 0.41 | 0.18 | 0.03 | 0.008 | 0.59 | 0.03 | 0.05 | V: 0.04, Mo: 0.03, Ca: 0.0006 |
| B27 | 0.008 | 0.15 | 0.13 | 0.031 | 0.0023 | 21.6 | 0.46 | 0.22 | 0.02 | 0.007 | 0.44 | 0.01 | 0.03 | — |
| B28 | 0.013 | 0.22 | 0.11 | 0.035 | 0.0024 | 20.8 | 0.36 | 0.18 | 0.01 | 0.006 | 0.51 | 0.01 | 0.02 | — |

| Steel Grade | Relational Expression (D | Relational Expression (2) | Shape of Weld Zone | Corrosion Resistance | Surface Quality | Note |
|---|---|---|---|---|---|---|
| B1 | 1.8 | 0.84 | ○ | ○ | ○ | Example Steel |
| B2 | 1.6 | 0.87 | ○ | ○ | ○ | Example Steel |
| B3 | 1.7 | 0.90 | ○ | ○ | ○ | Example Steel |
| B4 | 1.6 | 0.81 | ○ | ○ | ○ | Example Steel |
| B5 | 1.5 | 0.99 | ○ | ○ | ○ | Example Steel |
| B6 | 1.7 | 0.80 | ○ | ○ | ○ | Example Steel |
| B7 | 1.8 | 0.80 | ○ | ○ | ○ | Example Steel |
| B8 | 1.8 | 0.78 | ○ | ○ | ○ | Example Steel |
| B9 | 2.0 | 0.93 | ○ | ○ | ○ | Example Steel |
| B10 | 1.6 | 0.89 | ○ | ○ | ○ | Example Steel |
| B11 | 1.6 | 0.92 | ○ | ○ | ○ | Example Steel |
| B12 | 2.5 | 0.94 | ○ | ○ | ○ | Example Steel |
| B13 | 1.8 | 0.84 | ○ | ○ | ○ | Example Steel |
| B14 | 1.6 | 0.87 | ○ | ○ | ○ | Example Steel |
| B15 | 2.1 | 0.86 | ○ | ○ | ○ | Example Steel |
| B16 | 1.8 | 0.82 | ○ | ○ | ○ | Example Steel |
| B17 | 1.6 | 0.82 | ○ | ○ | ○ | Example Steel |
| B18 | 1.6 | 0.82 | ○ | ○ | ○ | Example Steel |
| B19 | 1.7 | 0.91 | ○ | ○ | ○ | Example Steel |
| B20 | 1.5 | 0.80 | ○ | ○ | ○ | Example Steel |
| B21 | 1.8 | 0.85 | ○ | ○ | ○ | Example Steel |
| B22 | 1.7 | 0.87 | ○ | ○ | ○ | Example Steel |
| B23 | 1.8 | 0.80 | ○ | ○ | ○ | Example Steel |
| B24 | 2.2 | 0.88 | ○ | ○ | ○ | Example Steel |
| B25 | 1.6 | 0.83 | ○ | ○ | ○ | Example Steel |
| B26 | 1.8 | 0.82 | ○ | ○ | ○ | Example Steel |
| B27 | 2.0 | 0.57 | ○ | ○ | x | Example Steel |
| B28 | 2.6 | 0.59 | ○ | ○ | x | Example Steel |

TABLE 3

| Steel | Chemical Composition (mass %) | | | | | | | | | | | | | |
|---|---|---|---|---|---|---|---|---|---|---|---|---|---|---|
| Grade | C | Si | Mn | P | S | Cr | Cu | Ni | Al | N | Nb | Ti | Zr | Other |
| A19 | 0.017 | 0.03 | 0.16 | 0.017 | 0.0012 | 21.5 | 0.38 | 0.29 | 0.02 | 0.006 | 0.55 | 0.01 | 0.02 | Mg: 0.0008 |
| A20 | 0.014 | 0.18 | 0.08 | 0.026 | 0.0024 | 21.4 | 0.51 | 0.44 | 0.04 | 0.011 | 0.42 | 0.05 | 0.06 | — |
| A21 | 0.024 | 0.21 | 0.15 | 0.021 | 0.0035 | 20.8 | 0.46 | 0.23 | 0.01 | 0.014 | 0.61 | 0.02 | 0.02 | — |
| A22 | 0.006 | 0.11 | 0.12 | 0.029 | 0.0031 | 21.1 | 0.45 | 0.22 | 0.04 | 0.025 | 0.49 | 0.01 | 0.01 | — |
| A23 | 0.008 | 0.12 | 0.15 | 0.025 | 0.0025 | 20.9 | 0.41 | 0.21 | 0.01 | 0.007 | 0.66 | 0.01 | 0.01 | V: 0.04, Ca: 0.0006 |
| A24 | 0.011 | 0.18 | 0.13 | 0.018 | 0.0032 | 21.3 | 0.43 | 0.18 | 0.04 | 0.009 | 0.42 | 0.02 | 0.01 | V: 0.03, Ca: 0.0011 |
| A25 | 0.012 | 0.16 | 0.15 | 0.026 | 0.0027 | 21.2 | 0.42 | 0.22 | 0.04 | 0.008 | 0.55 | — | 0.01 | — |
| A26 | 0.013 | 0.14 | 0.13 | 0.024 | 0.0035 | 20.8 | 0.41 | 0.23 | 0.02 | 0.007 | 0.58 | 0.02 | — | — |
| A27 | 0.007 | 0.18 | 0.12 | 0.021 | 0.0022 | 21.5 | 0.39 | 0.42 | — | 0.008 | 0.51 | 0.03 | 0.03 | — |
| B29 | 0.012 | 0.02 | 0.32 | 0.022 | 0.0022 | 21.2 | 0.31 | 0.16 | 0.04 | 0.008 | 0.35 | 0.01 | 0.01 | — |
| B30 | 0.011 | 0.11 | 0.15 | 0.022 | 0.0018 | 22.1 | 0.38 | 0.22 | 0.04 | 0.005 | 0.59 | 0.04 | — | — |
| B31 | 0.022 | 0.17 | 0.22 | 0.021 | 0.0021 | 21.1 | 0.42 | 0.21 | 0.05 | 0.006 | 0.61 | 0.01 | 0.01 | — |
| B32 | 0.008 | 0.08 | 0.24 | 0.011 | 0.0022 | 21.5 | 0.45 | 0.25 | 0.04 | 0.025 | 0.62 | 0.02 | 0.03 | — |
| B33 | 0.011 | 0.21 | 0.15 | 0.035 | 0.0024 | 21.1 | 0.41 | 0.22 | 0.04 | 0.008 | 0.59 | — | 0.04 | — |
| B34 | 0.007 | 0.07 | 0.21 | 0.027 | 0.0038 | 20.9 | 0.43 | 0.19 | 0.02 | 0.009 | 0.66 | 0.12 | 0.02 | — |
| B35 | 0.008 | 0.18 | 0.17 | 0.022 | 0.0015 | 21.3 | 0.42 | 0.35 | — | 0.007 | 0.59 | 0.06 | 0.04 | — |

| Steel Grade | Relational Expression (1) | Relational Expression (2) | Shape of Weld Zone | Corrosion Resistance | Surface Quality | Note |
|---|---|---|---|---|---|---|
| A19 | 3.5 | 0.66 | x | ○ | x | Comparative Steel |
| A20 | 0.9 | 0.73 | x | ○ | x | Comparative Steel |
| A21 | 2.8 | 0.71 | ○ | x | x | Comparative Steel |
| A22 | 1.7 | 0.65 | ○ | x | x | Comparative Steel |
| A23 | 4.7 | 0.73 | x | ○ | x | Comparative Steel |
| A24 | 1.2 | 0.60 | x | ○ | x | Comparative Steel |
| A25 | 1.9 | 0.69 | x | x | x | Comparative Steel |
| A26 | 2.8 | 0.68 | x | x | x | Comparative Steel |
| A27 | 2.8 | 0.62 | x | ○ | x | Comparative Steel |
| B29 | 1.5 | 0.51 | x | x | x | Comparative Steel |
| B30 | 1.8 | 0.79 | x | x | x | Comparative Steel |
| B31 | 1.7 | 0.80 | ○ | x | ○ | Comparative Steel |
| B32 | 2.0 | 0.83 | ○ | x | ○ | Comparative Steel |
| B33 | 1.7 | 0.77 | x | x | x | Comparative Steel |
| B34 | 1.7 | 0.99 | x | ○ | x | Comparative Steel |
| B35 | 2.4 | 0.77 | x | ○ | x | Comparative Steel |

The invention claimed is:

1. A ferritic stainless steel sheet having a chemical composition containing, by mass %, C: 0.003% to 0.020%, Si: 0.01% to 1.00%, Mn: 0.01% to 0.50%, P: 0.040% or less, S: 0.010% or less, Cr: 20.0% to 24.0%, Cu: 0.20% to 0.80%, Ni: 0.01% to 0.60%, Al: 0.01% to 0.08%, N: 0.003% to 0.020%, Nb: 0.40% to 0.80%, Ti: 0.01% to 0.10%, Zr: 0.01% to 0.10%, and the balance being Fe and inevitable impurities, wherein a combination of Ti, Nb, Zr, Si, and Al present in the chemical composition satisfy relational expression (1) below:

$$3.0 \geq Nb/(2Ti+Zr+0.5Si+5Al) \geq 1.5 \quad (1),$$

where, in relational expression (1), each of the atomic symbols denotes the content (mass %) of the corresponding chemical element, wherein a shape of a weld zone of the ferritic stainless steel sheet has no SAG or no UNDERCUT and wherein a case of a SAG is defined as a part of a weld fusion zone, of the ferritic stainless steel sheet, being 0.15 mm or more lower than the positions of two base metals butted on the right- and left-hand sides of the weld fusion zone, and a case of an UNDERCUT is defined as a thickness of the weld fusion zone at a position where the weld fusion zone is in contact with the base metal is 0.15 mm or more thinner than that of the base metal.

2. The ferritic stainless steel sheet according to claim 1, wherein the combination of Ti, Nb, Zr, and Al present in the chemical composition satisfy relational expression (2):

$$2Ti+Nb+1.5Zr+3Al \geq 0.75 \quad (2),$$

where, in relational expression (2), each of the atomic symbols denotes the content (mass %) of the corresponding chemical element, and wherein the weld zone, after application of tensile stress according to JIS No. 5, has a surface quality defined by a maximum height roughness Rz of 10 μm or less.

3. The ferritic stainless steel sheet according to claim 2, wherein the chemical composition further contains, by mass %, V: 0.01% to 0.30%.

4. The ferritic stainless steel sheet according to claim 3, wherein the chemical composition further contains, by mass %, one or both of Mo: 0.01% to 0.30% and Co: 0.01% to 0.30%.

5. The ferritic stainless steel sheet according to claim 4, wherein the chemical composition further contains, by mass %, one or more of B: 0.0003% to 0.0050%, Ca: 0.0003% to 0.0050%, Mg: 0.0005% to 0.0050%, REM: 0.001% to 0.050%, Sn: 0.01% to 0.50%, and Sb: 0.01% to 0.50%.

6. The ferritic stainless steel sheet according to claim 3, wherein the chemical composition further contains, by mass %, one or more of B: 0.0003% to 0.0050%, Ca: 0.0003% to 0.0050%, Mg: 0.0005% to 0.0050%, REM: 0.001% to 0.050%, Sn: 0.01% to 0.50%, and Sb: 0.01% to 0.50%.

7. The ferritic stainless steel sheet according to claim 2, wherein the chemical composition further contains, by mass %, one or both of Mo: 0.01% to 0.30% and Co: 0.01% to 0.30%.

8. The ferritic stainless steel sheet according to claim 7, wherein the chemical composition further contains, by mass %, one or more of B: 0.0003% to 0.0050%, Ca: 0.0003% to 0.0050%, Mg: 0.0005% to 0.0050%, REM: 0.001% to 0.050%, Sn: 0.01% to 0.50%, and Sb: 0.01% to 0.50%.

9. The ferritic stainless steel sheet according to claim 2, wherein the chemical composition further contains, by mass %, one or more of B: 0.0003% to 0.0050%, Ca: 0.0003% to 0.0050%, Mg: 0.0005% to 0.0050%, REM: 0.001% to 0.050%, Sn: 0.01% to 0.50%, and Sb: 0.01% to 0.50%.

10. The ferritic stainless steel sheet according to claim 1, wherein the chemical composition further contains, by mass %, V: 0.01% to 0.30%.

11. The ferritic stainless steel sheet according to claim 10, wherein the chemical composition further contains, by mass %, one or both of Mo: 0.01% to 0.30% and Co: 0.01% to 0.30%.

12. The ferritic stainless steel sheet according to claim 11, wherein the chemical composition further contains, by mass %, one or more of B: 0.0003% to 0.0050%, Ca: 0.0003% to 0.0050%, Mg: 0.0005% to 0.0050%, REM: 0.001% to 0.050%, Sn: 0.01% to 0.50%, and Sb: 0.01% to 0.50%.

13. The ferritic stainless steel sheet according to claim 10, wherein the chemical composition further contains, by mass %, one or more of B: 0.0003% to 0.0050%, Ca: 0.0003% to 0.0050%, Mg: 0.0005% to 0.0050%, REM: 0.001% to 0.050%, Sn: 0.01% to 0.50%, and Sb: 0.01% to 0.50%.

14. The ferritic stainless steel sheet according to claim 1, wherein the chemical composition further contains, by mass %, one or both of Mo: 0.01% to 0.30% and Co: 0.01% to 0.30%.

15. The ferritic stainless steel sheet according to claim 14, wherein the chemical composition further contains, by mass %, one or more of B: 0.0003% to 0.0050%, Ca: 0.0003% to 0.0050%, Mg: 0.0005% to 0.0050%, REM: 0.001% to 0.050%, Sn: 0.01% to 0.50%, and Sb: 0.01% to 0.50%.

16. The ferritic stainless steel sheet according to claim 1, wherein the chemical composition further contains, by mass %, one or more of B: 0.0003% to 0.0050%, Ca: 0.0003% to 0.0050%, Mg: 0.0005% to 0.0050%, REM: 0.001% to 0.050%, Sn: 0.01% to 0.50%, and Sb: 0.01% to 0.50%.

* * * * *